US011440016B2

(12) United States Patent
Nalon et al.

(10) Patent No.: US 11,440,016 B2
(45) Date of Patent: Sep. 13, 2022

(54) ROLLING MILL WITH DIRECT DRIVE MOTORS AND METHOD FOR OPERATING SAID ROLLING MILL

(71) Applicant: OMAS SRL, Arsego-San Giorgio delle Pertiche (IT)

(72) Inventors: Adriano Nalon, Arsego-San Giorgio delle Pertiche (IT); Gabriele Nicoletti, Arsego-San Giorgio delle Pertiche (IT)

(73) Assignee: OMAS SRL, Arsego— San Giorgio Delle Pertiche (IT)

( * ) Notice: Subject to any disclaimer, the term of this patent is extended or adjusted under 35 U.S.C. 154(b) by 12 days.

(21) Appl. No.: 15/780,010

(22) PCT Filed: Dec. 2, 2015

(86) PCT No.: PCT/IB2015/059276
§ 371 (c)(1),
(2) Date: May 30, 2018

(87) PCT Pub. No.: WO2017/093786
PCT Pub. Date: Jun. 8, 2017

(65) Prior Publication Data

US 2018/0353965 A1 Dec. 13, 2018

(30) Foreign Application Priority Data

Nov. 30, 2015 (IT) ..... 102015000078011

(51) Int. Cl.
*B02C 4/42* (2006.01)
*B02C 4/06* (2006.01)
(Continued)

(52) U.S. Cl.
CPC ..... *B02C 4/42* (2013.01); *B02C 4/06* (2013.01); *B02C 9/00* (2013.01); *B02C 9/04* (2013.01); *B02C 25/00* (2013.01)

(58) Field of Classification Search
CPC .... B02C 4/42; B02C 4/06; B02C 4/08; B02C 4/426; B21B 37/46; B21B 2275/05; B21B 2275/10; B21B 2203/26
(Continued)

(56) References Cited

U.S. PATENT DOCUMENTS 4,798,116 A * 1/1989 Silver ..... B02C 18/0007 241/168
6,213,749 B1 * 4/2001 Carle ..... A23G 1/10 425/141
2012/0047977 A1 * 3/2012 Smith ..... B21B 37/46 72/14.4

FOREIGN PATENT DOCUMENTS

DE 4110643 A1 10/1992
DE 10339733 A1 11/2004
(Continued)

OTHER PUBLICATIONS

Machine Translation of JP-2013106480-A, Shinya, Publication Year 2013, Total p. 22 (Year: 2020).*
(Continued)

*Primary Examiner* — Faye Francis
(74) *Attorney, Agent, or Firm* — Kristina Castellano; Castellano PLLC

(57) ABSTRACT

The invention is a mill or rolling mill for processing cereals, granular materials, mixtures of cereals and similar products, comprising at least one pair of parallel cylinders (C, C") positioned side by side, wherein each cylinder (C, C") of each pair is provided with a torque motor that in turn is mounted or assembled directly on the shaft of the respective cylinder (C, C"), and at least one control circuit (Z) suited to select which one of said two cylinders (C, C") of each pair rotates faster.

16 Claims, 3 Drawing Sheets

(51) Int. Cl.
*B02C 9/00* (2006.01)
*B02C 9/04* (2006.01)
*B02C 25/00* (2006.01)

(58) Field of Classification Search
USPC ..... 72/10.3
See application file for complete search history.

(56) References Cited

FOREIGN PATENT DOCUMENTS

| | | | | | |
|---|---|---|---|---|---|
| DE | 102011001047 | A1 | | 9/2012 | |
| FR | 2726490 | A1 | * | 5/1996 | ..... B02C 4/38 |
| GB | 261753 | A | * | 12/1927 | |
| JP | 2013106480 | A | * | 5/2013 | |
| WO | 2009068921 | A1 | | 6/2009 | |
| WO | 2012159932 | A1 | | 11/2012 | |

OTHER PUBLICATIONS

Written Opinion in PCT/IB2015/059276 dated Jun. 8, 2017.
International Search Report in PCT/IB2015/059276 dated Jul. 15, 2016.

* cited by examiner

ROLLING MILL WITH DIRECT DRIVE MOTORS AND METHOD FOR OPERATING SAID ROLLING MILL

CROSS REFERENCE TO RELATED APPLICATION

This is a U.S. National Stage application of PCT/IB2015/059276 filed on Dec. 2, 2015, which claims priority to Italian Patent Application 102015000078011 filed on Nov. 30, 2015, the contents of both of which are incorporated herein by reference.

The present invention concerns the sector of mills and rolling mills, and in particular it concerns a new improved type of rolling mill with synchronous direct drive torque motors with permanent magnets and the method for operating said rolling mill.

Rolling mills are known that are installed in mills and use pairs of cylinders to grind and process various products, like for example cereals, granular materials, cereal mixtures.

The cylinders of each pair are arranged so that they are parallel to each other and at a predetermined distance from each other, wherein if necessary said distance can be adjusted by means of special adjusting devices according to the product to be ground, to the final product desired and to the intermediate grinding step.

At present each pair of known cylinders is set rotating by an asynchronous electric motor connected through belt and pulley drive units or other mechanical coupling means.

A first cylinder, generally the front one, is set rotating by the asynchronous motor, while a belt drive system transmits motion in a synchronous manner to the second cylinder positioned beside the first cylinder and generally rotating at a lower speed compared to the latter and in the opposite direction.

The main control motor of each pair of cylinders is generally installed on one side of the grinding unit, while the opposite side is provided with a system of pulleys, tightening pulley and timing belt that makes it possible to maintain speed synchronism between the two cylinders. Said second belt, furthermore, has the function of:

- reducing the rotation speed and braking the rotation of the second rear cylinder during the grinding step with the cylinders in contact with each other,
- driving the second cylinder, and keeping it rotating, when the two cylinders are separated and the machine is at rest, ready for the successive grinding cycle.

The mechanisms and the rotation systems of the two known cylinders pose considerable drawbacks.

The drive units with belts and pulleys are noisy.

The various parts of the drive units are subject to wear and to breakages.

The belt drive units produce rubber powder due to wear.

The belt drive units cause energy losses due to the low efficiency of the drive unit.

The various parts of the drive units require periodic and regular checks and maintenance.

Both the motor and the various parts of the drive units occupy much space on both sides, thus requiring additional spaces and infrastructures for the installation of the rolling mills.

The asynchronous motors develop optimal rotation torques only within a determined rotation speed range. At rotation speeds different from the rated speed, the torque developed by the motors is considerably lower and it is not suitable for the required processing cycles.

It should also be considered that the two cylinders are operated by the same motor, with the same rotation speed or with different rotation speed.

The rolling mills having each pair of cylinders rotating at the same rotation speed do not obtain an optimal treatment for different types of cereals and grain products.

The rolling mills having pairs of cylinders in which each cylinder rotates at a different speed obtain a better treatment of cereals and grain products. In order to obtain different rotation speeds, it is necessary to connect the two cylinders with pulleys or gear wheels having different pitch diameter, thus obtaining a drive ratio different from 1, or different from the rated drive ratio.

If the difference between the rotation speeds of the two cylinders needs to be changed, it is necessary to stop them and install a different pair of pulleys.

The patent document DE102011011047 concerns a single cylinder connected to a motor with permanent magnets installed at the end of the cylinder itself and suited to produce the axial rotation of the cylinder, and wherein there is no contact between the rotor, which is integral with the cylinder, and the stator, which is mounted on the cylinder support in a radial position with respect to the stator. This document does not concern the mills and rolling mills for grinding and processing products such a cereals, granular materials, mixtures of cereals etc. but only the drive system that transmits the rotary motion to the cylinder.

The patent document DE10339733, analogously to the preceding document, concerns a single cylinder with a motor with permanent magnets installed axially with respect to the cylinder, wherein the rotor is integral with the cylinder, while the stator is mounted on the cylinder support.

The patent document WO2012159932 concerns a mill for reducing or transforming metal bars into sheets with suitable cross section. The mill comprises a plurality of rolling stands, wherein at least one of said rolling stands in turn comprises a pair of parallel cylinders positioned side by side and two synchronous motors, each one suited to rotate one cylinder.

The speed of the motors of each rolling stand can be varied individually but in a coordinated manner with respect to the speed of the motors of the other rolling stands. Furthermore, the absence of mechanical connections between the two cylinders of the same rolling stand allows the rotation speed to be controlled individually.

The document mentioned above does not solve the problems concerning the processing and grinding of cereals, granular materials, cereal mixtures, which need to be treated in a different manner according to their conditions at the beginning of the processing cycle and to their intended use.

In fact, the mills specifically dedicated to this type of use are known, in which the cylinders have a smooth or grooved cylindrical surface, meaning provided with a succession of projections with cross section substantially in the shape of saw teeth, that is, an asymmetrical triangular cross section, defining a cutting edge, or blade, and an inclined surface, or back.

"BRIEF DESCRIPTION OF THE FIGURES

FIG. 6 shows the cylinders (C',C") arranged in a matching manner so the blades (D1) of the teeth (D') of the first cylinder or front cylinder (C') are directed downwards, while the blades (D1) of the teeth (D") of the second cylinder (C") are directed upwards.

FIG. 7 shows how the back-back type of processing can be obtained without inverting the position of the cylinders (C', C"), but simply making the rear cylinder (C") rotate faster than the front cylinder (C').

FIG. 8 shows cylinders (C', C") arranged in a specular manner, in such a way that the blades (D1) of the teeth (D', D") of both cylinders (C', C") are directed downwards.

FIG. 9 shows how the back-blade type of processing can be obtained without inverting the position of the cylinders (C', C"), but simply making the rear cylinder (C") rotate faster than the front cylinder (C').

Figure 4:
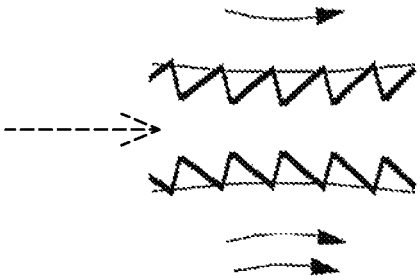
FIGS. 1-4 show how two opposing cylinders may be oriented in accordance with the present invention to obtain the present processing, where the cylinder rotating at the higher speed (indicated by a double arrow) is the front cylinder, that is, the left one in FIGS. 1-4.
Figure 3:
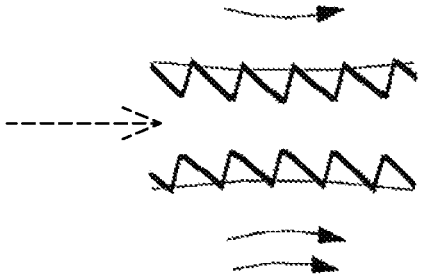
Figure 2:
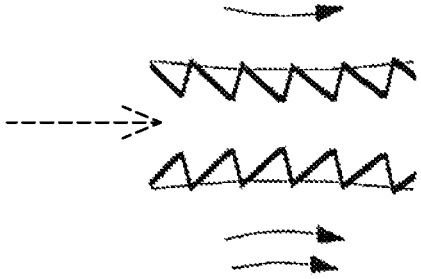
Figure 1:
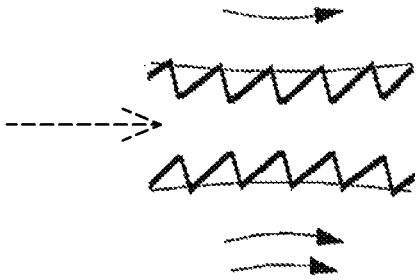

The relative rotation of a cylinder with respect to the adjacent cylinder, due to the different rotation speeds of the cylinders, determines which part of the teeth acts on the introduced material, thus processing the grains in a specific manner.

For example, when the desired type of processing includes the breaking of the grains, the following different processing cycles can be performed, according to how each one of said cylinders is mounted with respect to the opposing cylinder and to the relative speed of the cylinders:

1) blade-blade, in which the blades of both cylinders are used to process the material,
2) back-back, in which the backs of both cylinders are used to process the material,
3) blade-back, in which the blades of the first cylinder, or front cylinder, and the backs of the second cylinder, or rear cylinder, are used to process the material,
4) back-blade, in which the backs of the first cylinder, or front cylinder, and the blades of the second cylinder, or rear cylinder, are used to process the material.

Figures from 1 to 4 schematically show how the two opposing cylinders presently need to be oriented in order to obtain the desired type of processing, wherein the cylinder rotating at the higher speed, indicated by a double arrow, is presently always the front cylinder, that is, the left one.

The right cylinder, or rear cylinder, instead, rotates at a lower speed, indicated by a single arrow.

The material is introduced from above, and the feeding direction is indicated by a broken arrow.

One or the other of said types of processing, or a sequence of the same, is applied according to the type of material and its granulometry, and also according to the final product to be obtained.

Therefore the operators, in order to perform each one of said types of processing or a sequence of the same, must interrupt the operation of the machine, disassemble the cylinders and reinstall them as required.

Said operations prolong the processing times, in addition to increasing the risk of accidents for the operators.

It is also known that for each type of material to be processed there is a specific processing sequence. At present, however, in order to optimize processing times and to avoid the need to continuously intervene in the operation of the machine and interrupt the processing cycles, different mixtures of cereals are preferably processed in a substantially undifferentiated manner, which however results in a low quality finished product.

In order to overcome all of the said drawbacks, a new improved rolling mill with direct drive motors has been designed and implemented, in addition to a method for the operation of the rolling mill.

The main object of the present invention is to provide a rolling mill that makes it possible to carry out various types of processing on the grains with no need to disassemble any part of the machine, but by simply adjusting the operating programme of the rolling mill.

It is another object of the present invention to reduce processing times.

It is another object of the present invention to provide a rolling mill that makes it possible to adapt the sequence of processing cycles and of operating parameters in an immediate and automatic manner, by means of preset or presettable programmes or "recipes". Said programmes or "recipes" can furthermore be updated or modified rapidly, even during the processing cycle.

It is another object of the present invention to provide a new rolling mill that allows the degree of wear of the cylinders and of all the parts subject to wear to be constantly monitored and therefore also foreseen, thus reducing maintenance and checking times and costs.

It is another object of the present invention to provide a rolling mill with reduced overall dimensions.

It is another object of the present invention to provide a rolling mill with a reduced number of parts to be assembled and reduced assembly times.

It is another object of the present invention to provide a rolling mill in which the rated torque can be made available for a wide range of rotation speeds.

It is another object of the present invention to provide a rolling mill that makes it possible to manage and set different rotation speeds while at the same time maintaining the delivered torque constant.

It is another object of the present invention to provide a rolling mill in which it is possible to vary the rotation speed of each cylinder of each pair with no need to modify or work on mechanical parts.

It is another object of the present invention to provide a rolling mill in which more power or torque is transferred to the cylinders while using the same motor power.

It is another object of the present invention to provide a rolling mill that allows part of the rotation energy of the cylinders to be recovered.

It is another object of the present invention to provide a rolling mill with reduced maintenance.

It is another object of the present invention to provide a rolling mill that makes it possible to control the torque parameters and the number of revolutions of each cylinder, thus allowing the operators to manage the machine in the best possible way, adjusting it according to the most varied grinding specifications.

It is another object of the present invention to provide a rolling mill in which it is possible to control the speed of each motor.

It is another object of the present invention to increase the degree of safety for the operators, avoiding both the need to disassemble and reassemble parts of the machine too often and the presence of dangerous moving members such as belts, transmissions and gear wheels.

An advantage offered by the invention lies in that it is possible to vary the feeding rate of the material to be treated in the machine, synchronizing the speeds of the grinding cylinders also with the speed of the mill's feeding roller, always guaranteeing the optimal grinding of the product obtained, with no vibrations and reduced noise.

These and other direct and complementary objects are achieved by the new improved rolling mill with direct drive motors and by the method for operating said rolling mill.

The new rolling mill comprises one or more pairs of rolling cylinders, wherein each cylinder of each pair is provided with a torque motor, in turn mounted or built directly on the cylinder shaft.

The cylinders of each pair are arranged so that they are parallel to and at a suitable distance from each other, so that the space included between the two cylinders themselves is optimal for grinding the product introduced therebetween.

Each cylinder comprises a rotation and supporting shaft supported by the frame of the rolling mill by means of a suitable structure.

Said torque motor, of the type with magnetic drive, is mounted or assembled on at least one end of each shaft.

Substantially, the rotor, meaning the part of the torque motor provided with permanent magnets, is fixed to the end of the cylinder shaft, while the stator is fixed to the structure, the stator being the corresponding part of the same torque motor provided with coils or windings that generate the rotating magnetic field with variable intensity.

In a possible solution, said rotor is connected directly to the end of said cylinder shaft, while said stator is constrained to the supporting flange of said cylinder shaft, so that it is positioned radially with respect to said rotor.

According to a variant embodiment, said rotor of the motor is connected to the end of the cylinder shaft in such a way that it is integral with the latter, while the stator is kept stationary by means of a reaction arm that makes it possible to transmit the torque to the shaft in addition to absorbing all the misalignments and slacks of the cylinders due to the grinding activity.

However, any other practical solution can be adopted to assemble each motor on the shaft of the respective cylinder.

A control circuit provides for monitoring and controlling the energy supplied to the coils and consequently the rotation parameters of the cylinder, said control circuit being constituted by two separate control units connected to the corresponding coil or winding, and possibly with sensors suited to detect the position of the cylinder, which are not indispensable as the position of the rotors of synchronous motors can be controlled through the control units that manage the rotation of the rotating magnetic field.

Said control circuit supplies the suitable coils or windings of the support or flange of the cylinder shaft with the required energy and alternance, so as to transmit the desired rotation speed and torque to the permanent magnets of the shaft and thus to the cylinder.

The control circuit supervises the rotation parameters of the two cylinders of each pair, thus making it possible to set the same speed or different speeds for the two cylinders of each pair.

In this way, said control circuit can set for one cylinder of the rolling pair a lower rotation speed than for the other cylinder coupled with it, and the former cylinder is thus braked, in such a way as to obtain the optimal processing and grinding of the grains introduced between the two cylinders.

The control circuit makes it also possible to decide which one of the two cylinders will rotate faster.

In particular, the faster cylinder can be either the front one or the rear one, indifferently, depending on the type of grinding to be obtained.

Therefore, in the case of pairs of grooved cylinders, used for example when the grains need to be broken, it is possible to carry out the following types of processing: a) blade-blade, b) back-back, c) blade-back, d) back-blade, with no need to disassemble the machine.

In fact, it is possible to carry out each one of said types of processing thanks to said control circuit that varies the relative speeds of said two grinding cylinders, wherein said speed difference between the cylinders can be varied during the operation of the machine with no need for any interruption.

According to the invention, the rotation direction of one or both of the cylinders can be inverted, for example in case of blockages in the machine or for cleaning purposes.

As the torque motors operate in a reversible manner, owing to the driving action exerted by the faster cylinder on the slower cylinder, which takes place through the product being ground, it is possible to recover part of the energy supplied by the mains, due exactly to the difference between the rotation speeds of the two cylinders.

By properly connecting the two control units using a connection of the DC-BUS type or another type, carried out downstream of the power rectifiers, it is possible to obtain, from the slower motor, the generation of energy that is immediately made available to the faster motor. The slower cylinder and, consequently, the motor connected to it are driven by the product being ground, which acts as a driving element for the faster cylinder.

The advantages achieved by the new improved rolling mill are the following.

First of all, the possibility to change the speed ratio between the two cylinders automatically through the control circuit, with no need to stop and above all to disassemble the machine, revolutionizes the grinding process known up to date. In fact, according to the type of product to be ground and to the starch damage level to be obtained, it will be possible to vary the speed and possibly even the rotation direction of each one of the two cylinders, as well as their rotation ratio, according to the finished product to be obtained.

In addition to the above, high energy savings are obtained owing to the recovery of the energy supplied by the slower cylinder. Furthermore, differently from the motors of the traditional rolling mills that absorb 40% of the installed power when running idle, the motors of the new rolling mill that is the subject of the invention absorb 10-12% of the installed power. Therefore, all the power saved in order to maintain the rolling mill running idle compared to the traditional motors will be available during the grinding step. Furthermore, during the grinding step further 30% energy can be saved owing to the recovery action performed by the motor installed on the slower cylinder. This means that, compared to traditional motors, the system with two torque motors allows the slower motor to make part of the electric energy taken from the electricity mains available for the faster motor.

The application with the new motors provides the control circuit with a whole series of parameters that make it possible to manage the grinding process in an optimal manner. In fact, through the two control units it is possible to control the following:

a. torque of each motor;

b. number of revolutions;

c. power absorption;

d. temperature;

e. speed ratio.

All the above and possible other parameters allow several preset programmes to be run on the control circuit. This makes it possible to obtain the desired product according to specifications that are perfectly repeatable and therefore not subject to errors due to manual management.

According to the type of cereal, it is thus possible to apply the preset or in any case presettable programme or "recipe", in which all the processing parameters and the exact sequence of operations are defined in a precise and repeatable manner, wherein said parameters and operations will be set automatically controlling speed, torque and rotation direction of each cylinder of each pair.

Said programmes or "recipes" can successively be updated and in any case modified or added according to the type of product that has to be obtained from time to time. This is possible thanks to the new technology applied, which allows all the operating parameters to be controlled and completely, immediately and automatically modified.

The new rolling mill comprises also a device suited to control the clamping force of the grinding cylinders, which makes it possible to verify and reproduce the intensity of the grinding stress due to the adjustment of the distance between the two cylinders. This device consists of two load cells or another means suited to measure the clamping force of the cylinders. The force value that can be read on the control device is communicated to said control circuit that acts on the motor management parameters in such a way as to obtain the desired grinding intensity.

In particular, according to the power absorption and to the stress of the load cells, it is possible to manage also the feeding rate of the material to be processed.

The attached table shows a practical embodiment of the invention by way of non-limiting example.

Figure 5:
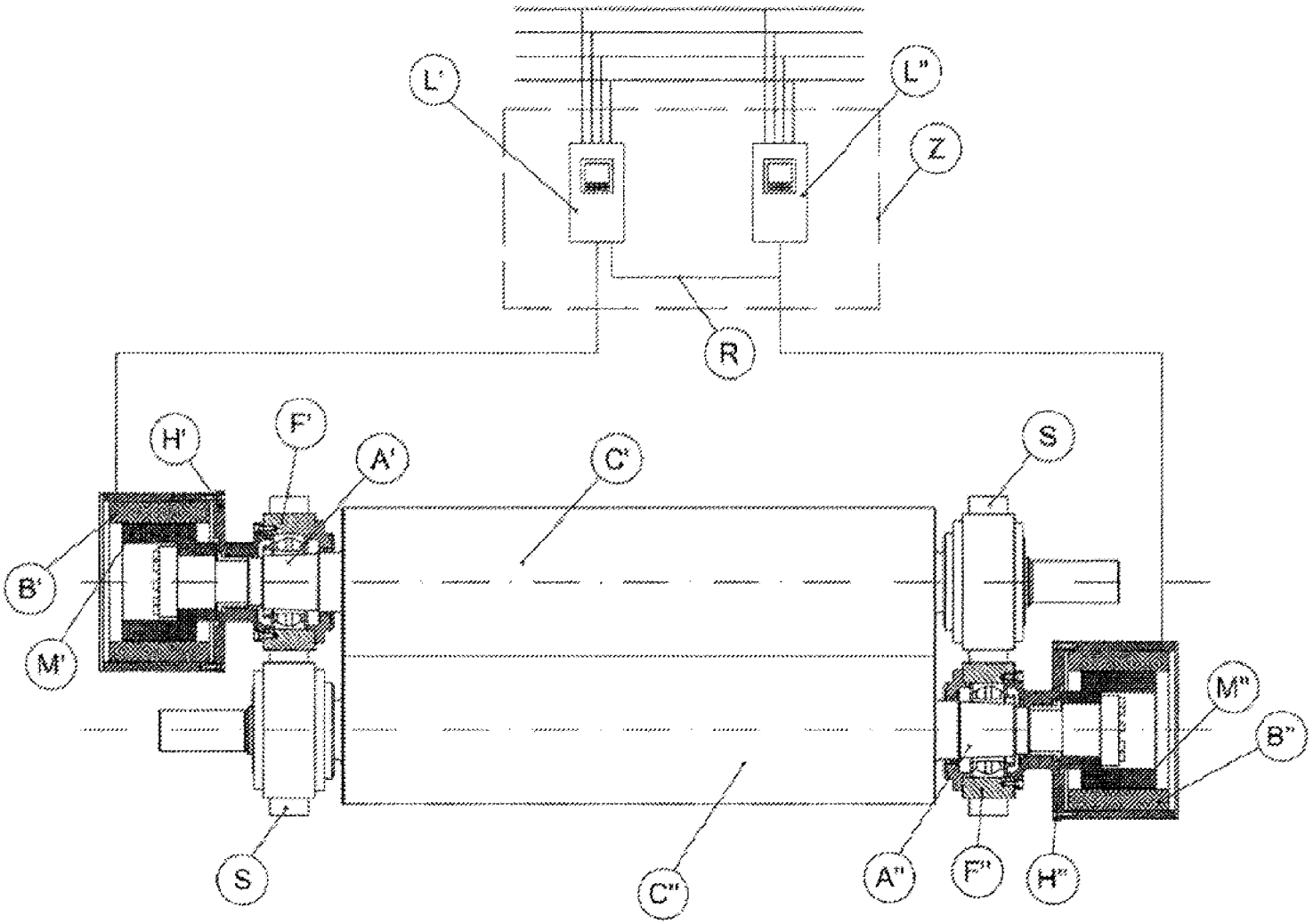
FIG. 5 shows a pair of cylinders (C', C") of a rolling mill in accordance with non-limiting embodiments of the present invention.

FIG. 5 shows a pair of cylinders (C', C") of a rolling mill, but the explanation provided below is to be understood as valid for rolling mills equipped with two or more pairs of cylinders (C', C").

Each cylinder (C', C") is arranged with its shaft (A', A") parallel to the shaft (A", A') of the other cylinder (C", C').

The end of the shaft (A', A") of each cylinder (C', C") is housed and rotates in a support or supporting flange (F', F") that is integral with the structure (S) of the rolling mill.

The rotor of the magnetic motor is applied to the end of each shaft (A', A"), and in particular a series of identical permanent magnets (M', M") are applied, mounted, connected or in any way joined to said end of the shaft (A', A"), said permanent magnets being arranged along the circumference so that they are equidistant from each other.

Said permanent magnets (M', M"), located on the generatrix of the end of the shaft (A', A") of the cylinder (C', C") and arranged longitudinally with respect to the shaft of the cylinder (C', C") itself, constitute said rotor of each torque motor.

A series of coils or windings (B', B") constituting the second part of each torque motor, meaning the stator, are fixed to the structure (S) of the rolling mill.

In the example shown in FIG. 5, said coils or windings (B', B") are fixed to the structure (S) of the rolling mill through a connection flange (H', H"). Said coils (B', B") are, therefore, installed around the end with said permanent magnets (M', M") of the shaft (A', A"), in such a way as to be arranged radially with respect to said permanent magnets (M', M").

All the coils or windings (B', B") of all the cylinders (C', C") are connected to a control circuit (Z).

Said control circuit (Z) controls and feeds the coils or windings (B', B") of each one of the two cylinders (C', C") independently, by means of the two control units (L', L").

The control unit (L') of the motor of the faster cylinder (C') serves the function of master, while the control unit (L") of the motor of the slower cylinder (C") is set as slave. In particular, said control circuit (Z) feeds the suitable coils or windings (B', B") with suitable intensity and frequency, or alternates the power supply sequence, in such a way as to transmit the desired torque and rotation speed to the permanent magnets (M', M") and thus to the cylinders (C', C").

The control circuit (Z) supervises the rotation parameters of the two cylinders (C', C"), making it possible to set the same speed or different speeds for said two cylinders (C', C").

For example, said control circuit (Z) can set the same rotation speed for both of the cylinders (C', C"), or it can set the rotation torque of each one of the two cylinders (C', C") at the same or different values, or it can set for one cylinder (C') a lower speed than for the other cylinder (C") coupled with it, so that the former cylinder is thus braked.

Furthermore, said control circuit (Z) can provide a setting according to which the first cylinder (C') is set rotating at a determined speed while the motor of the second cylinder (C") rotates at a lower speed. In this way, the second cylinder (C") is driven by the motion of the first cylinder (C') and by the material introduced between the cylinders (C', C"). Said second cylinder (C") is braked by its motor and then the corresponding control unit (L"), through the feedback connection (R), makes part of the recovered energy available for the motor of the first cylinder (C'), supplying it directly to the control unit (L').

FIGS. 6, 7, 8, 9 show how the type of processing can be changed without varying the arrangement of the cylinders (C', C"), but simply varying their rotation speed, wherein the higher speed is indicated by a double arrow, the lower speed is indicated by a single arrow, and the direction of introduction of the material from above is indicated by a broken arrow.

Said cylinders (C', C") have a smooth or grooved surface (C1), as shown in FIGS. 6-9, that is, comprising a plurality of projections (D', D") with cross section substantially in the shape of saw teeth, that is, an asymmetrical triangular cross section, each projection defining a cutting edge, or blade (D1), and an inclined surface, or back (D2).

Figure 6:
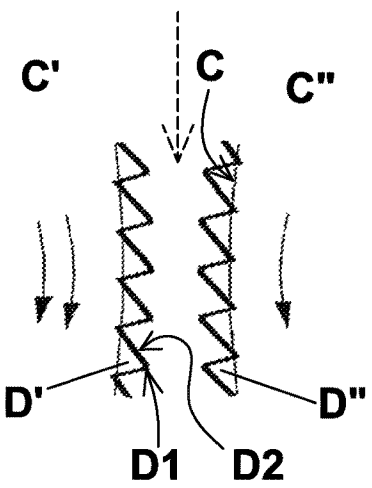
FIGS. 6-9 show how the type of processing can be changed without varying the arrangement of the cylinders (C', C"), but simply varying their rotation speed, wherein the high speed is indicated by a double arrow, the lower speed is indicated by a single arrow, and the direction of introduction of the material is indicated by a broken arrow.

In FIG. 6 said cylinders (C', C") are arranged in a matching manner, that is, so that the blades (D1) of the teeth (D') of the first cylinder or front cylinder (C') are directed downwards, while the blades (D1) of the teeth (D") of the second cylinder or rear cylinder (C") are directed upwards. The blade-blade processing is obtained with said front cylinder (C') rotating at a higher speed than the rear cylinder (C").

Figure 7:
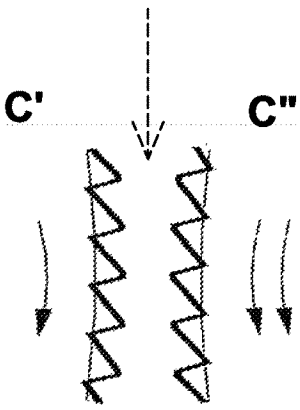

FIG. 7 schematically shows how the back-back type of processing can be obtained without inverting the position of the cylinders (C', C"), but simply making the rear cylinder (C") rotate faster than the front cylinder (C').

Figure 8:
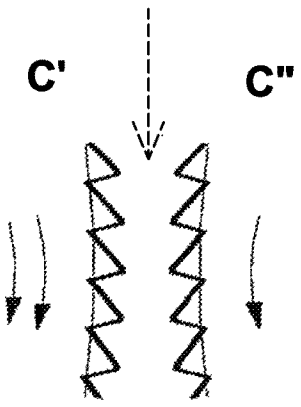

In FIG. 8 said cylinders (C', C") are arranged in a specular manner, that is, in such a way that the blades (D1) of the teeth (D', D") of both cylinders (C', C") are directed downwards. The blade-back type of processing is obtained with said front cylinder (C') rotating at a higher speed than the rear cylinder (C").

Figure 9:
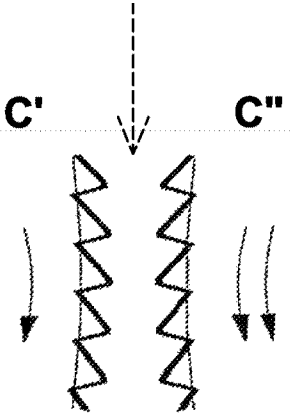

FIG. 9 schematically shows how the back-blade type of processing can be obtained without inverting the position of the cylinders (C', C"), but simply making the rear cylinder (C") rotate faster than the front cylinder (C').

The new rolling mill preferably comprises also means or devices suited to serve as an interface with the user or with an external terminal, for the input and/or setting and/or modification of data and controls related to the processing parameters.

A further technological advantage lies in that it is possible to adjust the feeding rate of the material to be processed in the machine.

It is known that rolling mills, in their upper part, are provided with a roller device, or feeding roller, which collects the material to be ground from an accumulation hopper that is incorporated in the machine and conveys it to the underlying grinding cylinders. The speed of said feeding roller is variable and determines the capacity of the machine.

In traditional rolling mills, the speed of the faster grinding cylinder and the differential ratio of the two speeds are fixed parameters, which can be modified only by changing the mechanical structure of the machine. In several instances, if the grinding capacity of the rolling mill needs to be increased, the speed of the feeding roller is increased, but this is possible only until the maximum peripheral speed of the grinding cylinders exceeds the speed transmitted by the feeding roller to the product that is reaching the cylinders.

This relationship between the two speeds guarantees a grinding homogeneity that is fundamental to obtain an optimal finished product. In the opposite case, if the speed of the grinding cylinders were lower than the speed of the product reaching the cylinders, the material would accumulate on said cylinders, with consequent grinding non-homogeneity, increased vibrations and noise due to continuous hitting.

Thanks to the new rolling mill, which comprises also means for controlling the speed of the feeding roller, it is possible to synchronize the two speeds, meaning the speed of the feeding roller and that of the grinding cylinders. The object is to ensure that the grinding speed is always higher than the feeding speed, so that for all the operating speeds of the machine it is possible to obtain optimal grinding results with no vibrations and reduced noise.

These are the schematic outlines that are sufficient to the expert in the art to carry out the invention, consequently, in the construction step variants may be developed that do not affect the substance of the innovative concept introduced herein.

Therefore, with reference to the above description and the attached drawings, the following claims are expressed.

The invention claimed is:

1. A rolling mill for grinding and processing cereals, granular materials, and mixtures of cereals, said rolling mill comprising:

a pair of parallel cylinders comprising a first cylinder and a second cylinder positioned side by side, wherein the first cylinder and the second cylinder are provided with a respective torque motor, the torque motor being mounted on a shaft of the respective cylinder or being built directly on the shaft of the respective cylinder; and a control circuit to which a respective set of coils or windings of the motor of the first cylinder and of the motor of the second cylinder, respectively, is connected, the control circuit being capable to supervise rotation parameters of said first and second cylinders;

wherein said first and second cylinders have a grooved surface, comprising a plurality of projections with cross section in a shape of saw teeth, an asymmetrical triangular cross section, each projection defining a cutting edge, or blade, and an inclined surface, or back;

wherein the control circuit controls a power supply and change of polarity or power intensity of said coils or windings of the motors in an independent manner through respective control units and wherein the control circuit selects which one of the first and second cylinders rotates faster, thus defining a faster cylinder and a slower cylinder for the pair of parallel cylinders, and thus further defining a faster torque motor and a slower torque motor, respectively;

wherein said faster cylinder can selectively be the first cylinder or the second cylinder according to a processing of cereals, granular materials, mixtures of cereals to be obtained, whereby by making the first cylinder rotate faster it is possible to obtain a processing of cereals, granular materials, mixtures of cereals that is different from a processing cereals, granular materials, mixtures of cereals obtained by making the second cylinder rotate faster; and wherein the control units control operating parameters comprising torque of each motor, number of revolutions of the cylinders, power absorption, temperature and speed ratio between the cylinders, said control circuit comprises a plurality of predefined programs comprising one or more sequences of said operating parameters, wherein said programs are selectable according to the type of cereals to be grinded.

2. The rolling mill according claim 1, wherein said motors are synchronous and comprise permanent magnets, each motor having a rotor integral with an end of the shaft of each of the first and second cylinder, and wherein the motors comprise a stator constrained to a fixed supporting structure of the shaft of each of the first and second cylinder, respectively, and wherein said rotor comprises the permanent magnets arranged in proximity to the end of the shaft of each of the first and second cylinder, said permanent magnets being arranged along the circumference of the respective shaft in such a way that said magnets are equidistant from each other, while said stators comprise the coils or windings fixed to said supporting structure, the coils or windings being arranged radially around the end provided with the permanent magnets of each shaft and wherein each set of said coils or windings are arranged radially around said permanent magnets without contacting the permanent magnets during rotation.

3. The rolling mill according to claim 2, wherein said coils or windings are fixed to said supporting structure through flanges.

4. The rolling mill according to claim 3, wherein said coils or windings are constrained with at least one reaction arm to limit their rotation and transmit a desired torque to one of the rotating shafts.

5. The rolling mill according to claim 1, wherein the rolling mill comprises a device for measuring a clamping force of the first and second cylinder, the device for measuring the clamping force being capable of communicating detected values of the clamping force to the control circuit that controls management parameters of the motors of said first and second cylinders.

6. The rolling mill according to claim 1, wherein the rolling mill comprises an interface with a user interface or an external terminal, the interface with the user interface or the external terminal being configured for insertion and/or setting and/or modification of data and controls related to processing parameters.

7. The rolling mill according to claim 1, wherein the control circuit controls the power supply and the change of polarity of the coils or windings of the motors of the first and second cylinders by transmitting a higher rotation speed and torque for one of the two cylinders while in the other cylinder, which is the slower cylinder, the respective motor operates as a brake, wherein the control units comprise a control unit of the slower motor and a control unit of the faster motor, and wherein the control unit of the slower motor carried out recovers energy not used by the slower cylinder, making the energy recovered by the control unit of the slower motor available to the faster motor and transmitting the recovered energy directly to the respective control unit of the faster motor.

8. The rolling mill according to claim 7, wherein the energy from the slower motor is recovered through a feedback connection.

9. The rolling mill according to claim 1, wherein the rolling mill further comprises a feeding roller feeding the pair of cylinders with material to be processed, and a controller of the speed of the feeding roller, the speed being controlled by the controller to synchronize a speed of the feeding roller and grinding speeds of said cylinders for the purpose of guaranteeing that a grinding speed of the material to be processed exceeds a feeding speed of the material.

10. The rolling mill according to claim 1, wherein said coils or windings are constrained with at least one reaction arm to limit their rotation and transmit a desired torque to one of the rotating shafts.

11. A method for operating a rolling mill according to claim 1, comprising:

transmitting a higher rotation speed and torque to the first cylinder or to the second cylinder, according to a process to be carried out, wherein said control circuit controls the power supply and the change of polarity of the coils or windings of the motors of the pair of cylinders.

12. The method according to claim 11 for operating the rolling mill, wherein the blades of the teeth of the first cylinder are directed downwards, and the blades of teeth of the second cylinder are directed upwards, so that:

said first cylinder rotating at a higher speed than the second cylinder for blade-blade processing of material; and said first cylinder rotating at a lower speed than the second cylinder for back-back processing of material.

13. The method according to claim 11 for operating the rolling mill, wherein said cylinders are arranged in a specular manner, the blades of teeth of said cylinders being directed downwards, so that:

said first cylinder rotating at a higher speed than the second cylinder for blade-back processing of material; and said first cylinder rotating at a lower speed than the second cylinder for back-blade processing of material.

14. The method according to claim 11 for operating the rolling mill, wherein the control circuit comprises a plurality of predefined programs comprising one or more sequences of operating parameters.

15. A rolling mill for grinding and processing cereals, granular materials, and mixtures of cereals, said rolling mill comprising:

a pair of parallel cylinders comprising a first cylinder and a second cylinder positioned side by side, wherein the first cylinder and the second cylinder are provided with a respective torque motor, the torque motor being mounted on a shaft of the respective cylinder or being built directly on the shaft of the respective cylinder; and a control circuit to which a respective set of coils or windings of the motor of the first cylinder and of the motor of the second cylinder, respectively, is connected, the control circuit being capable to supervise rotation parameters of said first and second cylinders;

wherein said first and second cylinders have a grooved surface, comprising a plurality of projections with cross section in a shape of saw teeth, an asymmetrical triangular cross section, each projection defining a cutting edge, or blade, and an inclined surface, or back;

wherein the control circuit controls a power supply and change of polarity or power intensity of said coils or windings of the motors in an independent manner through respective control units and wherein the control circuit selects which one of the first and second cylinders rotates faster, thus defining a faster cylinder and a slower cylinder for the pair of parallel cylinders, and thus further defining a faster torque motor and a slower torque motor, respectively, wherein said faster cylinder can selectively be the first cylinder or the second cylinder according to a processing of cereals, granular materials, mixtures of cereals to be obtained, whereby by making the first cylinder rotate faster it is possible to obtain a processing of cereals, granular materials, mixtures of cereals that is different from a the processing cereals, granular materials, mixtures of cereals obtained by making the second cylinder rotate faster;

wherein the control circuit controls the power supply and the change of polarity of the coils or windings of the motors of the first and second cylinders by transmitting a higher rotation speed and torque for one of the two cylinders, while in the other cylinder, which is the slower cylinder, the respective motor operates as a brake, wherein the control units comprise a control unit of the slower motor and a control unit of the faster motor, and wherein the control unit of the slower motor recovers energy not used by the slower cylinder, making the energy recovered by the control unit of the slower motor available to the faster motor and transmitting the recovered energy directly to the respective control unit of the faster motor;

wherein the control units control operating parameters comprising torque of each motor, number of revolutions of the cylinders, power absorption, temperature and speed ratio between the cylinders, said control circuit comprises a plurality of predefined programs comprising one or more sequences of said operating parameters, wherein said programs are selectable according to the type of cereals to be grinded.

16. The rolling mill according to claim 15, wherein the energy from the slower motor is recovered through a feedback connection.

* * * * *